US008770086B2

(12) United States Patent
Enck

(10) Patent No.: US 8,770,086 B2
(45) Date of Patent: Jul. 8, 2014

(54) BLAST PROTECTION ATTACHMENT

(75) Inventor: Brian Enck, Sterling Heights, MI (US)

(73) Assignee: International Truck Intellectual Property Company, LLC, Lisle, IL (US)

( * ) Notice: Subject to any disclaimer, the term of this patent is extended or adjusted under 35 U.S.C. 154(b) by 22 days.

(21) Appl. No.: 13/601,389

(22) Filed: Aug. 31, 2012

(65) Prior Publication Data

US 2014/0060303 A1 Mar. 6, 2014

(51) Int. Cl.
*F41H 5/14* (2006.01)
*F41H 7/04* (2006.01)

(52) U.S. Cl.
CPC . *F41H 7/042* (2013.01); *F41H 7/04* (2013.01)
USPC ..... 89/36.09; 89/36.08; 89/36.07

(58) Field of Classification Search
CPC ..... F41H 7/042; F41H 7/04
USPC ..... 89/36.09, 36.08, 36.07
See application file for complete search history.

(56) References Cited

U.S. PATENT DOCUMENTS

| | | | | |
|---|---|---|---|---|
| 5,663,520 | A * | 9/1997 | Ladika et al. | 296/187.07 |
| 7,114,764 | B1 * | 10/2006 | Barsoum et al. | 296/193.07 |
| 7,255,034 | B2 * | 8/2007 | Strassgurtl et al. | 296/193.07 |
| 7,533,600 | B2 | 5/2009 | Marqueling | |
| 7,997,182 | B1 * | 8/2011 | Cox | 89/36.09 |
| 8,146,477 | B2 * | 4/2012 | Joynt | 89/36.08 |
| 8,413,567 | B2 | 4/2013 | Luther et al. | |

* cited by examiner

*Primary Examiner* — John Woodrow Eldred
(74) *Attorney, Agent, or Firm* — Jeffrey P. Calfa; Mark C. Bach

(57) ABSTRACT

A blast structure and system for use as an outer blast protection component for a personnel cabin for a vehicle, is disclosed. The blast protection system comprises a personnel cabin adapted for receiving a blast structure, the cabin comprising a space forming an interior of the cabin, a floor within the interior of the cabin, the floor having a perimeter section and a removable floor panel centrally disposed therein, a blast structure comprising at least one outer blast panel attachable to the perimeter when the floor panel is removed, and means for attaching and detaching the blast panel to the perimeter section, providing an outer blast protection component to the interior space of the cabin. The attaching/detaching means include fasteners which are accessible through the interior of the cabin, without breaching the exterior surface of the blast structure.

12 Claims, 1 Drawing Sheet

BLAST PROTECTION ATTACHMENT

TECHNICAL FIELD

The present device relates to a protective armor for critical areas of vehicles, including underbelly armor for military vehicles. More specifically, the device relates to a blast protection structure for securing through the interior floor surface of a personnel cabin when needed to protect the vehicle occupants from blast energy and fragmentation resulting from an explosive device.

BACKGROUND

Armored vehicles are threatened by improvised explosive devices (IEDs) designed to cause harm to the vehicle and its occupants. IEDs are typically one or more grouped artillery shells redeployed and detonated in an effort to inflict casualties. Harm from these devices typically comes in the form of high pressure blast energy and ballistic fragmentation in the following predominant ways: (1) rapid surface pressure and destructive hull deformation resulting in hull breach and direct occupant exposure to blast pressures and intense heat; (2) high velocity, hull and/or floor accelerations resulting in occupant incapacities; and (3) high velocity fragmentation passing through armor and impacting occupants.

Armor countermeasures typically consist of heavy metal plates placed between the threat and the vehicle in such a way as to resist hull breach and aggressive floor accelerations. These heavy metal plates also work in concert with layers of additional metal, ceramic, composite or plastic materials designed to prevent lethal high velocity artillery shell fragments from entering the vehicle. The heavy metal plates are typically mounted to the underside of the vehicle in a V-shape in an effort to take advantage of shape efficiency and deflection characteristics when presented with incoming pressure and fragmentation. Carrying heavy blast and fragment resistant hulls results in significant performance disadvantage to the vehicle in terms of reduced fuel economy, lost cargo capacity and increased transportation shipping costs, as well as, weight challenges for the environment the vehicles operate in.

Therefore, it would be advantageous to attach and detach a blast protection structure, specifically through the interior floor of the vehicle cabin, depending on the requirements of the situation and environment the vehicle will be subjected to. The present device is a blast protection structure, which includes a blast floor structure or panels having integrated fasteners for attachment to the exterior of the vehicle through the interior of the cabin. Because all of the fasteners are accessible from the inside of the cabin, the blast protection structure can be attached without disassembly of major vehicle components. In addition, accessibility of the fasteners from inside the vehicle avoids the necessity of the technician to be under the vehicle to secure the blast structure, which improves overall safety. Finally, while the fasteners are secured through the interior of the vehicle, they do not pass through the exterior blast structure after attachment. Attachment of the fasteners in this manner maintains the structural integrity of the blast structure. The present blast structure is designed to protect the occupants from blast energy and fragmentation, and offers a simple, cost-effective means for adding additional protection to the vehicle.

SUMMARY

There is disclosed herein an improved system and structure for protecting a personnel cabin of a military vehicle which avoids the disadvantages of prior systems while affording additional structural and costs advantages.

Generally speaking, the present device is a blast structure for use as an upgraded armored protection for the exterior of a personnel cabin for a vehicle. The blast structure comprises at least one blast panel attachable to surfaces of the personnel cabin and means for attaching and detaching the blast panel to the surfaces, wherein attachment of the blast panel forms an outer contiguous blast protection component.

A blast protection system for use on a vehicle, is disclosed. The blast protection system comprises a personnel cabin of a vehicle adapted for receiving a blast structure, the cabin comprising a space forming an interior of the cabin, a floor within the interior of the cabin, the floor having a perimeter section and a removable floor panel centrally disposed therein, a blast structure comprising at least one outer blast panel attachable to the perimeter when the floor panel is removed, and means for attaching and detaching the blast panel to the perimeter section, wherein the blast panel replaces the floor panel to provide an outer blast protection component to the interior space of the cabin.

These and other features and advantages of the blast protection structure and system can be more readily understood from the following detailed discussion with reference to the appended drawing figures.

DETAILED DESCRIPTION

Figure 1:
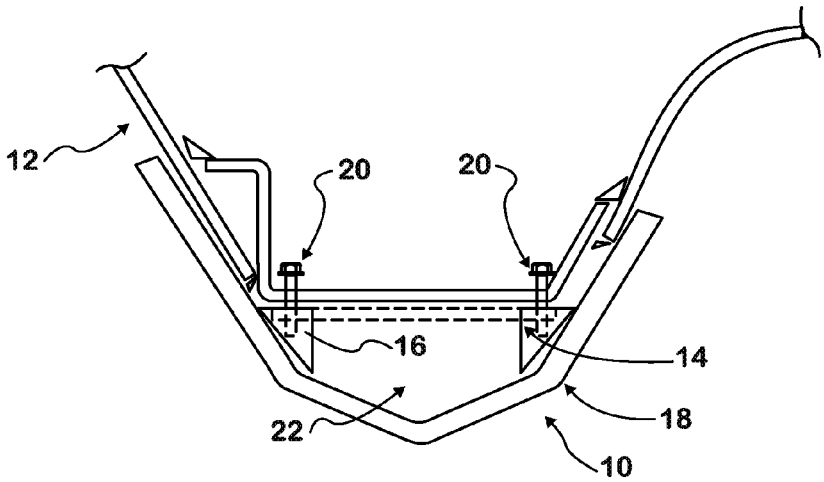
FIG. 1 is cross sectional view of a personnel cabin with the blast protection structure.
Figure 2:
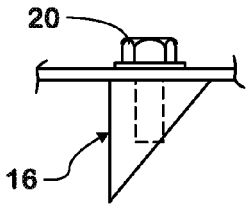
FIG. 2 is a perspective view of a fastener for securing the blast protection structure; and, FIG. 3 is plan view of the blast protection structure attached to the personnel cabin.
Figure 3:
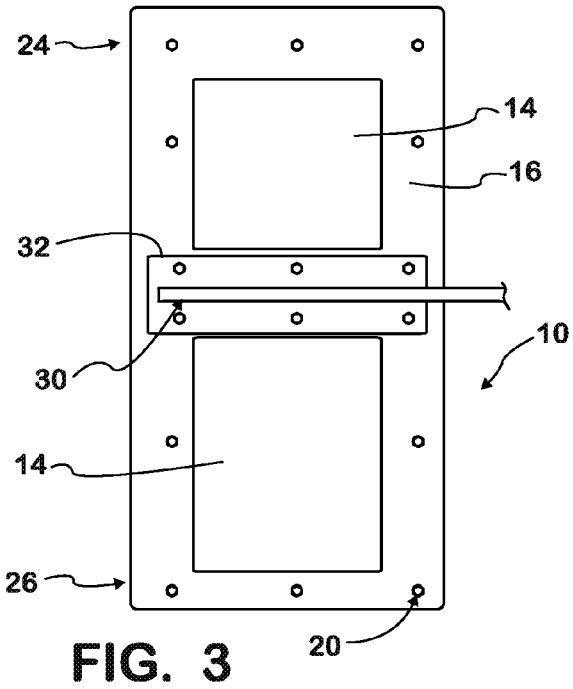

Referring to FIGS. 1-3, there is illustrated an embodiment of the detachable blast structure generally designated by the numeral 10, as well as the components thereof. The blast structure 10 is designed for use as an attachable blast structure to provide additional blast protection to the personnel cabin 12 of a vehicle (not shown), particularly a military vehicle, which is used in war-zones for transporting personnel or cargo. However, other military vehicles may also be retrofitted with embodiments of the present device 10 to protect both military personnel as well as components of the propulsion system (e.g., drive axles, engine, etc.) when the vehicle encounters an explosive device.

The blast structure 10 includes a perimeter section 16 of the floor, and outer blast surface 18 and a blast absorbing section 22. When needed, a current floor or closure panel 14 is removed, leaving the perimeter section 16 of the cabin floor. The blast structure 10 and its outer blast surface 18 attaches to the perimeter section 16, forming the "new" underside of the cabin 12. Fasteners 20 accessible from the interior of the cabin, would be used to secure the blast structure 10 to the perimeter section 16 of the floor. It should be understood, however, that the blast structure 10 can be attached to any portion of the cabin needing additional protection, using a simplified attachment means through the interior of the cabin. In this manner, the blast structure 10 and its outer blast surface 18 functions to diminish or halt certain classes of ballistic and blast threats, while providing a structural and automotive function as part of the occupant cabin and/or chassis configuration of the vehicle.

Armored vehicles having integrated blast solutions are often extremely heavy to begin with, and face weight challenges for the environments they operate in. Additionally, because of their weight, such vehicles are often a challenge for transporting to locations where they are needed. Thus, it would be advantageous to have an attachable/detachable blast system, which permits the attachment of a blast structure only when needed, or alternatively, provides the option to remove a large portion of the weight on the vehicle so it can be transported, and/or not carry weight that is not needed.

Generally speaking, the blast structure 10, may have any suitable shape. As shown in FIG. 1, the blast structure has an angular or concave shape, wherein the "point" of the blast structure faces the ground. While a specific shape or embodiment of the blast structure will be illustrated, it should be understood that other configurations, such as those created by sharper, rectangular, or square lines, and peaks and valleys, may also be used in creating the configuration of the blast structure. The plurality of high and low areas create deflection faces and venting openings, which deflect and vent the blast and resulting fragmentation away from the interior or personnel section of the cabin 12, as well as, separation distances for separating the interior of the cabin from the blast force. The high and low areas of the blast structure further act to dissipate the force of the explosion. Additionally, the shape of the blast structure 10 can be adapted for attachment to any shape chassis for any vehicle because of its vertical fastener component.

The blast structure 10 may be constructed from a single panel material, such as high-strength low-alloy steel, a hardened aluminum, or high carbon steel, or any combination of these materials. Alternatively, the blast structure may be constructed as a layered composite structure, the composite includes outer layers or outer blast surfaces 18, which are generally metal that are bonded or adhered to an inner layer or layers composed of a "fragmentation catching" material. In addition, the inner layer creates a distance or space between the outer metal layers resulting in a second modulus or modulus of rigidity, which is better able to resist bending resulting from blast pressure when compared to traditional blast hulls. This section modulus is achieved at a reduced mass through use of the present composite structure when compared to monolithic metal panels with the same section modulus. The inner layers slow approaching fragmentation, i.e., reducing kinetic energy, and breaks up fragments into smaller pieces creating fragment dispersion and reducing individual fragment mass. The inner layer acts primarily as the mechanism for "fragmentation catching," but also provides a secondary function as the "separation filler," between the outer layers, thereby increasing the section modulus, as described above, and enhancing the overall structural rigidity. The materials for construction of the blast structure 10, as well as the thicknesses and dimensions of the blast structure may vary depending on the requirements of the vehicle and areas on which it will be used.

When an upgrade in armored protection is required, the floor panel 14 from the interior floor of the cabin 12 is removed, leaving the perimeter section 16. The blast structure 10 is then installed, replacing the floor panel 14. Attachment of the blast structure to the cabin 12 can be accomplished by any known fastener means. For examples, screws or bolts 20, such as shown in FIG. 2, are commonly used to attach the blast structure to the cabin structures, including sidewalls 13. However, it should be understood that any known fastener, including but not limited to studs, bolts and nuts that are suitable for the present application could be used.

The fasteners 20 are vertically attached through the perimeter section 16 of the interior floor of the cabin and into the blast structure 10. However, when the fasteners 20 are in place, there is no breach of the fasteners through the outer surface 18 of the blast structure. Attachment of the fasteners in this manner maintains the continuity and integrity of the structure. Regardless of the type of fastener used, it should be compatible with standard tools that can be carried in the field, quickly attachable and detachable, and readily available. In addition, because the fasteners 20 are all on a common plane with the perimeter section 16, they are easily aligned with the blast structure, and as mentioned, permit the blast structure to be attached to any chassis shape. All fasteners are easily accessible from the inside of the cabin, allowing the user to retrofit a vehicle without disassembling major vehicle components. Additionally, because the fasteners are on the inside, the technician does not have to be under the vehicle to secure the blast structure to the perimeter section, which adds another level of safety. Finally, the number and positioning of fasteners 20 to be used would be based on structural requirements.

When the blast structure 10 is attached to the cabin 12, there is created blast absorbing section 22 between the blast structure and the interior of the cabin 12. This section 22 may include additional fragment absorbing materials, such as egg crate or honey comb shaped absorbing surfaces or materials. Such material may include foamed plastics or aluminum. Alternatively, the section 22 may be an air gap. The section 22, whether filled with a fragment absorbing material or structure or an air gap provides an additional measure of protection to the occupants of the cabin 12 as it further deflects the fragments from entering the interior of the cabin.

FIG. 3 shows a plan view of the cabin 12 with the blast structure 10 attached. The top of FIG. 3 represents the front 24 of the cabin, which is generally the vehicle driver section, and the bottom of FIG. 2 represents the rear 26 of the cabin, which is generally for personnel. A bulkhead 30 separates the front 24 of the cabin from the rear 26 of the cabin. The bulkhead 30 may be welded to the perimeter section 16, or bolted through a plate. In this particular embodiment, the bulkhead 30 may also be surrounded by a floor section or flange 32, which attaches to the bulkhead and the blast structure 10. Any blast force reaching the blast structure 10 would be transmitted directly into the bulkhead 30 in addition to the cabin structures providing greater support and strength to the overall cabin structure.

The attachable/ removable blast system and structure 10 of the present disclosure is designed to meet or exceed military requirements for hull breach and occupant performance criteria when subjected to a given type of blast threat. In addition, the blast structure 10 meets the requirements for minimal floor (subfloor) deformation and tactical load requirements, while being manufactured at competitive costs. The blast structure and its modular components provide the advantage of accommodating various shapes of vehicles, and are independently attachable/detachable to meet weight and varying levels of required protection. Because the fasteners used to attach the blast structure are secured through the inside of the vehicle, and do not pass through the outer blast surface of the structure, an additional level of safety and structural integrity is attributable to the structure.

What is claimed is:

1. A blast protection structure for a personnel cabin of a vehicle, the structure comprising:

at least one blast panel attachable to surfaces of the personnel cabin; and, means for attaching and detaching the blast panel to the surfaces, wherein attachment of the blast panel forms an outer contiguous blast protection component, wherein the blast panel replaces a floor panel in the personnel cabin.

2. The blast protection structure of claim 1, wherein the blast panel comprises an angular shape.

3. The blast protection structure of claim 1, wherein the means for attaching and detaching comprises a fastener.

4. The blast protection structure of claim 3, wherein the fastener is one of a bolt, a screw and a stud.

5. The blast protection structure of claim 3, wherein the fastener is integral with the blast panel.

6. The blast protection structure of claim 5, wherein the fastener for attaching the blast panel is accessible through an interior space of the cabin.

7. A blast protection system for use on a vehicle, the system comprising:

a personnel cabin of a vehicle adapted for receiving a blast structure, the cabin comprising:

a space forming an interior of the cabin;

a floor within the interior of the cabin, the floor having a perimeter section and a removable floor panel centrally disposed therein;

a blast structure comprising:

at least one blast panel having an outer blast surface, the blast panel attachable to the perimeter when the floor panel is removed; and, means for attaching and detaching the blast panel to the perimeter section, wherein the blast panel replaces the floor panel to provide an outer blast protection component to the interior space of the cabin.

8. The blast protection system of claim 7, wherein the means for attaching and detaching the blast panel to the perimeter section comprises a fastener.

9. The blast protection system of claim 8, wherein the fastener is one of a bolt, a screw and a stud.

10. The blast protection system of claim 9, wherein the fastener is integral with the blast panel.

11. The blast protection system of claim 10, wherein the fastener for attaching the blast panel is accessible through an interior space of the cabin.

12. The blast protection system of claim 11, wherein the fastener does not breach the outer blast surface of the blast panel maintaining a contiguous protection surface.

* * * * *